United States Patent [19]

Hiraga et al.

[11] Patent Number: 4,514,150

[45] Date of Patent: Apr. 30, 1985

[54] SCROLL TYPE COMPRESSOR WITH DISPLACEMENT ADJUSTING MECHANISM

[75] Inventors: Masaharu Hiraga, Honjo; Atsushi Mabe, Isesaki; Yuji Yoshii, Takasaki, all of Japan

[73] Assignee: Sanden Corporation, Gunma, Japan

[21] Appl. No.: 448,490

[22] Filed: Dec. 10, 1982

Related U.S. Application Data

[63] Continuation-in-part of Ser. No. 356,648, Mar. 9, 1982, Pat. No. 4,468,178.

[30] Foreign Application Priority Data

Mar. 9, 1981 [JP] Japan ..... 56-33646
Dec. 10, 1981 [JP] Japan ..... 56-198987

[51] Int. Cl.[3] ..... F04B 49/02; F04C 18/02; F04C 29/08

[52] U.S. Cl. ..... 417/440; 418/55

[58] Field of Search ..... 418/55; 417/304, 440; 137/870; 251/141

[56] References Cited

U.S. PATENT DOCUMENTS

| | | | |
|---|---|---|---|
| 3,386,472 | 6/1968 | Szonntagh | 251/141 |
| 3,751,001 | 8/1973 | Rayment | 251/141 |
| 4,192,152 | 3/1980 | Armstrong et al. | 418/55 |
| 4,216,661 | 8/1980 | Tojo et al. | 418/55 |
| 4,357,132 | 11/1982 | Kousokabe | 418/55 |
| 4,383,805 | 5/1983 | Teegarden et al. | 418/55 |

FOREIGN PATENT DOCUMENTS 2195270 3/1974 France .

*Primary Examiner*—John J. Vrablik
*Attorney, Agent, or Firm*—Banner, Birch, McKie & Beckett

[57] ABSTRACT

A scroll type compressor including a housing, a fixed scroll which is joined to the housing and including a first end plate from which a first wrap extends and an orbiting scroll which includes a second end plate from which a second wrap extends. The wraps interfit at an angular and radial offset to make a plurality of line contacts to define at least one pair of sealed off fluid pockets. The first end plate is formed with a plurality of pairs of holes, the holes of each pair of holes being placed at symmetrical positions. The most inwardly placed hole is placed at a location defined by involute angles within the area defined by $\phi end-2(n-1)\pi>\phi 1->\phi end-2n$, where $\phi end$ is the final involute angle of the wrap which extends from the end plate having the holes, $\phi 1$ is the involute angle at which the hole is placed and n is the amount of pairs of holes. The most outwardly placed hole is placed at a location defined by involute angles within the area defined by $\phi n-1+2\pi>\phi n>\phi end-2\pi$. The intermediate holes are located within an area defined by $\phi k-1+2\pi>\phi k>\phi k+1-2\pi$, where $\phi k$ is the involute angle at which hole kth from the most inwardly placed hole is located. A control mechanism controls the opening and closing of the holes to thereby control the capacity or displacement volume of the compressor.

6 Claims, 9 Drawing Figures

SCROLL TYPE COMPRESSOR WITH DISPLACEMENT ADJUSTING MECHANISM

CROSS REFERENCE TO RELATED APPLICATION

This application is a continuation-in-part of application Ser. No. 356,648 filed on Mar. 9, 1982 by Masaharu Hiraga, Atsushi Mabe and Yuji Yoshii, and assigned to the same assignee now U.S. Pat. No. 4,468,178.

BACKGROUND OF THE INVENTION

This invention relates to a compressor, and more particularly, to a scroll type compressor for an air conditioning apparatus which includes a mechanism for adjusting the displacement of the compressor.

Scroll type fluid displacement apparatus are well known in the prior art. For example, U.S. Pat. No. 801,182 (Creux) discloses a device including two scrolls each having a circular end plate and a spiroidal or involute spiral element. These scrolls are maintained angularly and radially offset so that both spiral elements interfit to make a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets changes. Since the volume of the fluid pockets increases or decreases dependent on the direction of the orbital motion, this scroll type fluid displacement apparatus is applicable to compress, expand or pump fluids.

Scroll type fluid displacement apparatus are suitable for use as refrigerant compressors in air conditioners. In such air conditioners, thermal control in the room or control of the air conditioner is generally accomplished by intermittent operation of the compressor. Once the temperature in the room has been cooled to a desired temperature, the refrigerant capacity of the air conditioner for supplemental cooling, because of further temperature changes in the room, or for keeping the room at the desired temperature, generally need not be very large. However, since prior art air conditioners do not have capacity control mechanisms, after the room has been cooled to the desired temperature, the output of the compressor is controlled by intermittent operation of the compressor. Thus, the relatively large load which is required to drive the compressor is intermittently applied to the driving source.

When prior art scroll compressors are used in automotive air conditioners, they are driven by the automobile engine through an electromagnetic clutch. Once the passenger compartment reaches a desired temperature, control of the output of the compressor is accomplished by intermittent operation of the compressor through the electromagnetic clutch. Thus, the relatively large load which is required to drive the compressor is intermittently applied to the automobile engine.

Therefore, it is desirable to provide a scroll compressor with a displacement or volume adjusting mechanism which controls the compression ratio as occasion demands. In a scroll type compressor, the adjustment of the displacement can be easily accomplished by controlling the volume of the sealed off fluid pockets. A displacement adjusting mechanism is disclosed in our copending application Ser. No. 356,648, filed on Mar. 9, 1982. This latter application discloses a mechanism including a pair of holes formed through one of the end plates of one of the scrolls. The holes are placed in symmetrical positions so that the wrap of the other scroll simultaneously crosses over the holes. In this compressor, the holes are placed within an area between $\phi$end and $\phi$end-$2\pi$, where $\phi$end is the final involute angle of the wrap. Because of the location of these holes in the area between the end of the wrap and $\phi$end-$2\pi$, part of the fluid in the sealed off fluid pockets leaks to the suction chamber through the holes. As a result, no compression takes place until the fluid pockets pass the hole at location defined $\phi$end-$2\pi$. However, when the holes are placed within the area between $\phi$end and $\phi$end-$2\pi$, the volume reduction ratio or capacity adjustment capability is limited.

SUMMARY OF THE INVENTION

It is a primary object of this invention to improve a scroll type compressor by incorporating a mechanism for changing the compression ratio of the compressor as occasion demands without the loss of energy consumption.

It is another object of this invention to provide a scroll type compressor in which the volume reduction ratio of the fluid pocket is freely selected as occasion demands without useless operation of the compressor.

It is still another object of this invention to provide a scroll type compressor in which sealing of the fluid pockets is maintained while achieving the above objects.

It is a further object of this invention to provide a scroll type compressor which is simple in construction and can be simply and reliably manufactured.

A scroll type compressor according to this invention includes a pair of scrolls. Each scroll includes an end plate and a wrap extending from one side surface of the end plate. The wraps interfit at an angular and radial offset to make a plurality of line contacts and define at least one pair of sealed off fluid pockets. One of the scrolls (an orbiting scroll) is driven in orbital motion by the rotation of a drive shaft, while the rotation of the orbiting scroll is prevented. The fluid pockets shift along the spiral curved surface of the wrap, which changes the volume of the fluid pockets. One of the end plates has at least two pair of holes formed through it. The holes of each pair of holes are placed in symmetrical positions so that the wrap of the other scroll simultaneously crosses over the holes. The most inwardly placed pair of holes is placed within an area between $\phi$end-$2\pi$ and $\phi$end-$4\pi$, where $\phi$end is the final involute angle of the wrap which extends from the end plate having the holes. A further pair of holes is placed with the outward hole within an area between $\phi$end and $\phi$end-$2\pi$.

A control device controls the opening and closing of the holes to control the displacement volume of the fluid pockets. When the holes are closed, compression operates normally and the displacement volume is not changed. When the holes are opened by the control device, fluid in the sealed off pockets flows back into the suction chamber through the holes until the spiral element of the other scroll crosses over the inwardly placed pair of holes. The displacement volume in the fluid pockets is thereby reduced, and compression starts at an intermediate stage.

Further objects, features and other aspects of this invention will be understood from the detailed description of the preferred embodiments of this invention with reference to the annexed drawings.

DETAILED DESCRIPTION OF THE INVENTION

Figure 1:
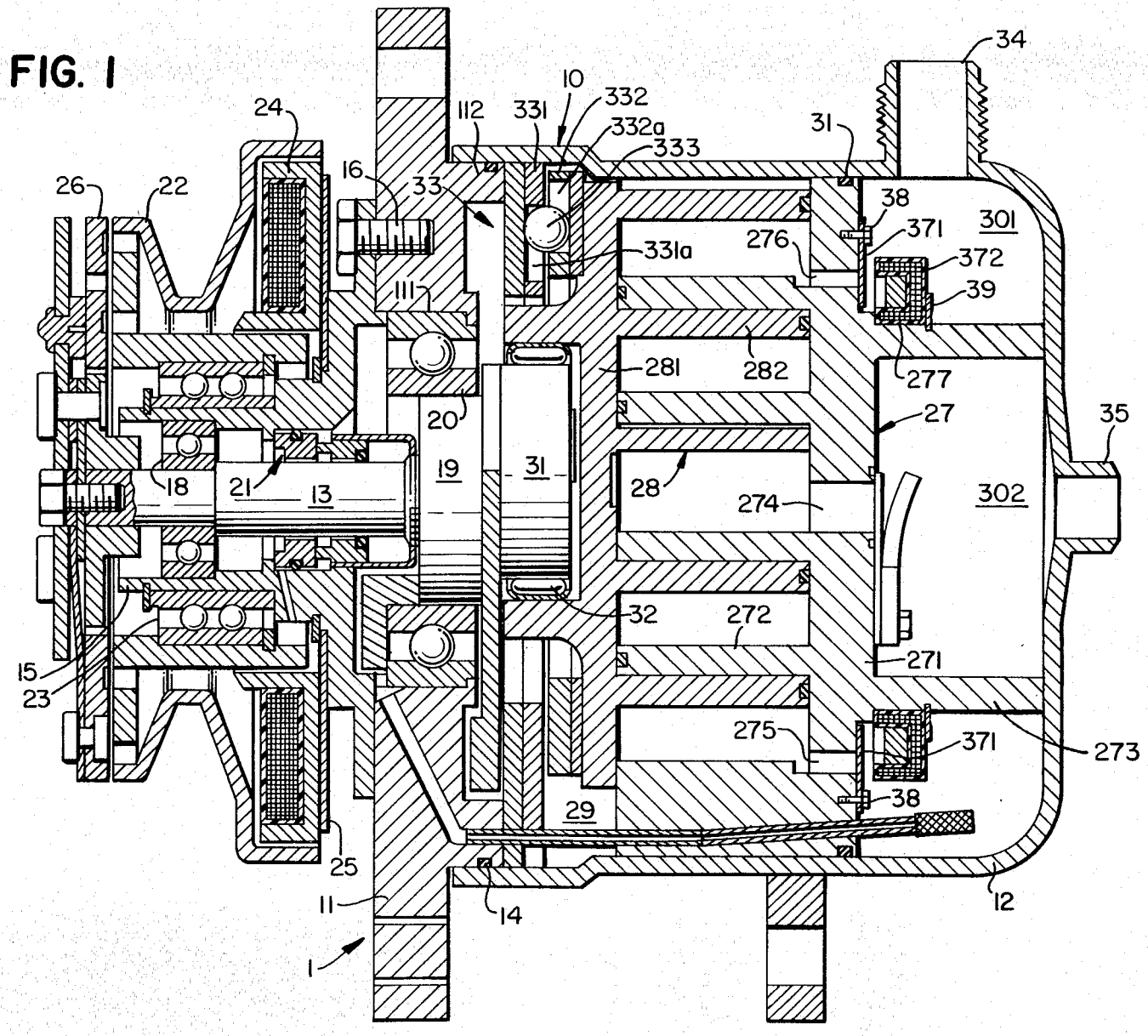
FIG. 1 is a vertical sectional view of a scroll type compressor unit according to an embodiment of this invention.

Referring to FIG. 1, a refrigerant compressor in accordance with an embodiment of the present invention, in particular, a scroll type refrigerant compressor 1, is shown. Compressor 1 includes compressor housing 10 having front end plate 11 and cup shaped casing 12 which is attached to an end surface of front end plate 11. Opening 111 is formed in the center of front end plate 11 for the penetration or passage of drive shaft 13. Annular projection 112 is formed in a rear end surface of front end plate 11. Annular projection 112 faces cup shaped casing 12 and is concentric with opening 111. An outer peripheral surface of annular projection 112 extends into an inner wall of the opening of cup shaped casing 12. Thus, cup shaped casing 12 is covered by front end plate 11. An O-ring 14 is placed between the outer peripheral surface of annular projection 112 and the inner wall of the opening of cup shaped casing 12 to seal the mating surfaces of front end plate 11 and cup shaped casing 12.

Annular sleeve 15 projects from the front end surface of front end plate 11 which surrounds drive shaft 13 and defines a shaft seal cavity. In the embodiment shown in FIG. 1, sleeve 15 is separate from front end plate 11. Therefore, sleeve 15 is fixed to the front end surface of front end plate 11 by screws 16. An O-ring is placed between the end surface of front end plate 11 and the end surface of sleeve 15 to seal the mating surfaces of front end plate 11 and sleeve 15. Alternatively, sleeve 15 may be integral with front end plate 11.

Drive shaft 13 is rotatably supported by sleeve 15 through bearing 18 located within the front end of sleeve 15. Drive shaft 13 has disk 19 at its inner end which is rotatably supported by front end plate 11 through bearing 20 located within opening 111 of front end plate 11. Shaft seal assembly 21 is coupled to drive shaft 13 within the shaft seal cavity of sleeve 15.

Pulley 22 is rotatably supported by bearing 23 which is carried on the outer surface of sleeve 15. Electromagnetic coil 24 is fixed about the outer surface of sleeve 15 by support plate 25 and is received in an annular cavity of pulley 22. Armature plate 26 is elastically supported on the outer end of drive shaft 13 which extends from sleeve 15. Pulley 22, magnetic coil 24 and armature plate 26 form a magnetic clutch. In operation, drive shaft 13 is driven by an external power source, for example the engine of an automobile, through a rotation transmitting device such as the above explained magnetic clutch.

A number of elements are located within the inner chamber of cup shaped casing 12 including fixed scroll 27, orbiting scroll 28, a driving mechanism for orbiting scroll 28 and a rotation preventing/thrust bearing device for orbiting scroll 28. The inner chamber of cup shaped casing 12 is formed between the inner wall of cup shaped casing 12 and the rear end surface of front end plate 11.

Fixed scroll 27 includes circular end plate 271, a wrap or spiral element 272 affixed to or extending from one side surface of end plate 271. Partition wall 273 axially projects from the opposite side surface of circular end plate 271. An axial end surface of partition wall 273 is seated against and connected to an inner surface of end plate 121 of cup shaped casing 12 by fasteners (not shown). Circular end plate 271 of fixed scroll 27 partitions the inner chamber of cup shaped casing 12 into first chamber 29 and second chamber 30. Seal ring 31 is disposed within a circumferential groove of circular end plate 271 to form a seal between the inner wall of cup shaped casing 12 and the outer wall of circular end plate 271. Spiral element 272 of fixed scroll 27 is located within first chamber 29 and partition wall 273 is located within second chamber 30. Partition wall 273 further divides second chamber 30 into suction chamber 301 and discharge chamber 302.

Orbiting scroll 28 which is located in first chamber 29, includes circular end plate 281 and a wrap or spiral element 282 affixed to or extending from one side surface of end plate 281. Spiral elements 272 and 282 interfit at an angular offset of 180° and a predetermined radial offset. The spiral elements define at least a pair of sealed off fluid pockets between their interfitting surfaces.

Orbiting scroll 28 is rotatably supported by bushing 31 through bearing 32 placed on the outer peripheral surface of bushing 31. Bushing 31 is connected to an inner end of disk 19 at a point radially offset or eccentric of the axis of drive shaft 13.

Rotation preventing/thrust bearing device 33 is placed between the inner end surface of front end plate 11 and the end surface of end plate 281 which faces the inner end surface of front end plate 11. Rotation preventing/thrust bearing device 33 includes fixed ring 331 attached to the inner end surface of front end plate member 11, orbiting ring 332 attached to the end surface of end plate 281, and a plurality of bearing elements, such as balls 333 placed between pockets 331*a*, 332*a* formed through rings 331 and 332. The rotation of orbiting scroll 28 during its orbital motion is prevented by the interaction of balls 333 with rings 331, 332; and the axial thrust load from orbiting scroll 28 is supported on front end plate 11 through balls 333.

Cup shaped casing 12 has an inlet port 34 and outlet port 35 for connecting the compressor unit with an external fluid circuit. Fluid is introduced from the external circuit into suction chamber 301 through inlet port 34 and flows into chamber 29 through a connecting hole formed through end plate 271 at a position near its outer peripheral surface. The fluid in chamber 29 is taken into the fluid pockets formed between spiral elements 272 and 282. As orbiting scroll 28 orbits, the fluid in the fluid pockets moves to the center of the spiral elements and is compressed. The compressed fluid is discharged into discharge chamber 302 from the fluid pockets in the general area of the center of the spiral elements through hole 274 formed through circular end plate 271. The compressed fluid then is discharged to the external fluid circuit through outlet port 35.

In operation, fluid generally is taken into the fluid pockets formed between spiral elements 272 and 282 through two open spaces. Each open space is defined between the outer terminal end of one of the spiral elements and the outer wall surface of the outer spiral element. The entrance to these open spaces sequentially open and close during the orbital motion of orbiting scroll 28. While the entrance to these open spaces remain open, fluid to be compressed flows into them, but no compression occurs. After the entrance to these open spaces closes, the sealed off fluid pockets are formed, no additional fluid flows into the pockets, and compression begins. The location of the outer terminal end of each spiral element 272 and 282 is at the final involute angle, therefore, the location of these open spaces is directly related to the final involute angle.

Figure 2:
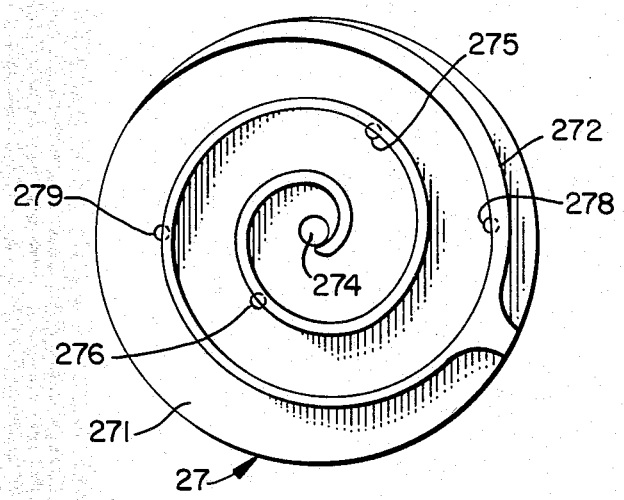
FIG. 2 is a front end view of the fixed scroll member used in the compressor of FIG. 1.

Referring to FIG. 2, the final involute angle ($\phi$end) at the end of spiral element 272 of fixed scroll 27 is greater than $4\pi$. At least two pair of holes 275, 276, 278 and 279 are formed in end plate 271 of fixed scroll 27. The holes of each pair of holes are placed at symmetrical positions so that an axial end surface of spiral element 282 of orbiting scroll 28 simultaneously crosses over the pair of holes. Holes 275 and 278 communicate between suction chamber 301 and one of the fluids pockets A, and holes 276 and 279 communicate between suction chamber 301 and the other fluid pocket A'.

Hole 275 of the first pair of holes is placed at a position defined by the involute angle $\phi 1$ and opens along the inner side wall of spiral element 272. The other hole 276 is placed at a position defined by the involute angle ($\phi 1$-$\pi$) and opens along the outer side wall of spiral element 272. The preferred area in which to place the first pair of holes 275 and 276, as defined by the involute angles, is given by $\phi\text{end}-2\pi > \phi 1 > \phi\text{end}-4\pi$. Thus, the holes 275 and 276 are simultaneously closed by spiral element 282 of orbiting scroll 28.

Hole 278 of the second pair of holes is placed at a position defined by the involute angle $\phi 2$ and opens along the inner side wall of spiral element 272. The other hole 279 is placed at a position defined by the involute angle ($\phi 2$-$\pi$) and opens along the outer side wall of spiral element 272. The preferred area within which to place the second pair of holes 278 and 279, as defined by the involute angles, is given by $\phi 1+2\pi > \phi 2 > \phi\text{end}-2\pi$. Thus, the second pair of holes along the spiral element 272, and are simultaneously closed by spiral element 282 of orbiting scroll 28.

The most inwardly placed hole of the first and second pairs of holes should ideally be located within an area defined by $\phi\text{end}-2(n-1)\pi > \phi 1 > \phi\text{end}-2n\pi$, where $\phi$end is the final involute angle of spiral element 272 and $\phi 1$ is the involute angle at which the most inwardly placed hole is located and n is the number of pairs of holes. The most outwardly placed hole of the first and second pairs of holes should ideally be located within an area defined by $\phi(n-1)+2\pi > \phi n > \phi\text{end}-2\pi$ and the intermediate holes between the most inner and the most outer holes should ideally be located within an area defined by $\phi(k-1)+2\pi > \phi(k+1)-2\pi$, where $\phi k$ is the involute angle at which the kth hole from the most inwardly placed hole is located.

Figure 3:
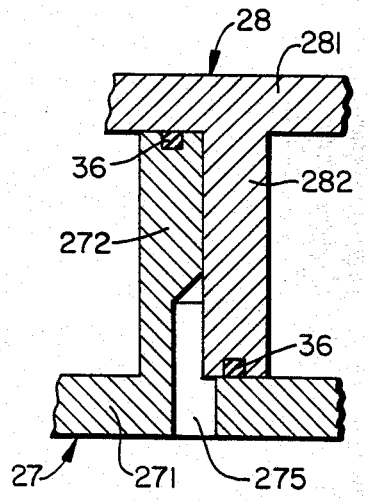
FIG. 3 is a sectional view of the spiral elements illustrating the hole extending into one of the spiral elements.
Figure 4:
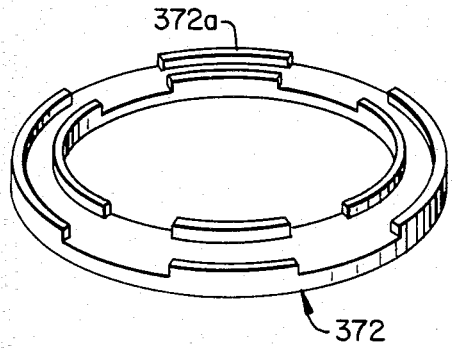
FIG. 4 is a perspective view of a magnetic coil used in the compressor of FIG. 1.

Holes 275, 276, 278 and 279 are formed by drilling into end plate 271 from the side opposite from spiral element 272. Holes 275 and 278 are drilled at a position which overlaps with the inner wall of spiral element 272, so that a portion of the inner wall of spiral element 272 is removed. Holes 276 and 279 are drilled at a position which overlaps the outer wall of spiral element 272 so that a portion of the outer wall of spiral element 272 is removed. This overlapping of hole 275 is shown in detail in FIG. 3. In this arrangement, the axial end surface of each spiral element is provided with a seal 36 which forms an axial seal between the spiral element and the facing end plate. Holes 275, 276, 278 and 279 are positioned so that they do not connect with the fluid pockets between the spiral elements when spiral element 282 completely overlaps the holes. This is accomplished by extending a portion of each hole into spiral element 272 with the result that seal element 36 in spiral element 282 remains completely in contact with end plate 271 when spiral element 282 completely overlaps the holes, while the size of holes 275, 276, 278 and 279 are kept sufficiently large.

Control mechanism 37, which is located in suction chamber 301, is connected to the outer peripheral surface of partition wall 273. Control mechanism 37 includes: (1) a valve member having a plurality of valve plates 371 which are attached to the end surface of end plate 271 at each hole 275, 276, 278 and 279; and (2) annular shaped electromagnetic coil 372 attached to the outer surface of partition wall 273.

Figure 5:
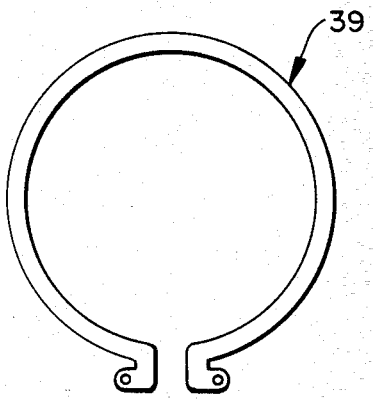
FIG. 5 is a front end view of a snap ring used in the compressor of FIG. 1; and FIGS. *6a–6d* are schematic views illustrating the operation of the volume or displacement adjusting mechanism utilizing a pair of holes.

Each valve plate 371 is made of a spring type magnetic material, and is attached to the end surface of end plate 271 by a fastener, such as screw 38. Magnetic coil 372 is fitted into groove 277 formed on the outer peripheral surface of partition wall 273, and is held therein against axial movement by a snap ring 39, as shown in FIG. 5. The inherent spring tendency of each valve plate 371 pushes it against the opening of a respective hole 275, 276, 278 and 279 to thus close the opening of each hole. Valve plates 371 are controlled by the operation of magnetic coil 372. By activating coil 372, the valve plates 371 are bent away from the openings in holes 275, 276, 278 and 279. Deactivating coil 371 permits the valve plates to again seal the openings to the holes because of their inherent spring tendency.

Magnetic coil 372 is provided with contact portions 372*a* at its end surface facing the valve plates 371. When valve plates 371 are drawn away from holes 275, 276, 278 and 279 by magnetic coil 372, they contact portions 372*a*.

Figure 6A:
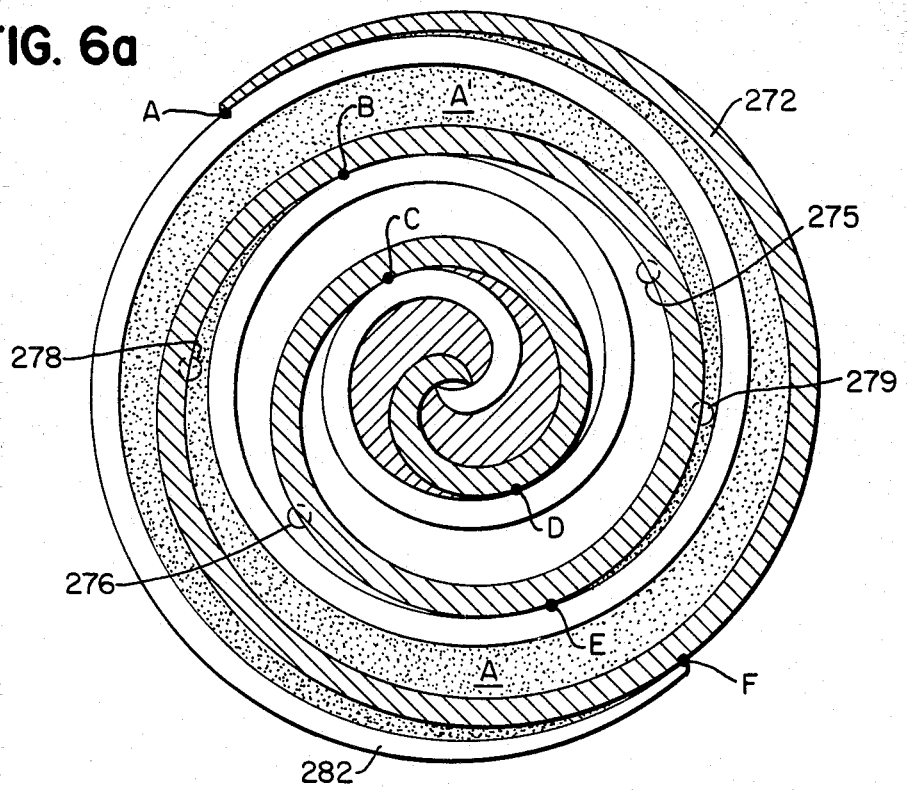

Referring to FIGS. 6*a*–6*d*, the operation of the mechanism for changing the displacement volume of the fluid pockets, i.e., the volume of the sealed off fluid pockets at the time compression begins, will be described. When, during orbital motion, the terminal end portion of both spiral elements 272, 282 are in contact with the opposite side wall of the other spiral element, a pair of fluid pockets A, A', which are defined between line contacts A-B and line contacts E-F, are sealed off and simultaneously formed at symmetrical locations, as shown in FIG. 6*a*. If holes 275, 276, 278 and 279 are closed by valve member 371, compression of the fluid taken into the fluid pockets through the open space between the spiral elements begins. The fluid in these fluid pockets moves toward the center of the spiral elements during orbital motion of the orbiting scroll which results in volume reduction and compression as shown in FIGS. 6*a*–6*d*. This fluid eventually is discharged into discharge chamber 302 through hole 274. In the above operative mode, compression operates normally and the displacement volume of the sealed off fluid pockets is determined when the terminal ends of the spiral elements first contact the opposite side wall of the other spiral element.

Figure 6B:
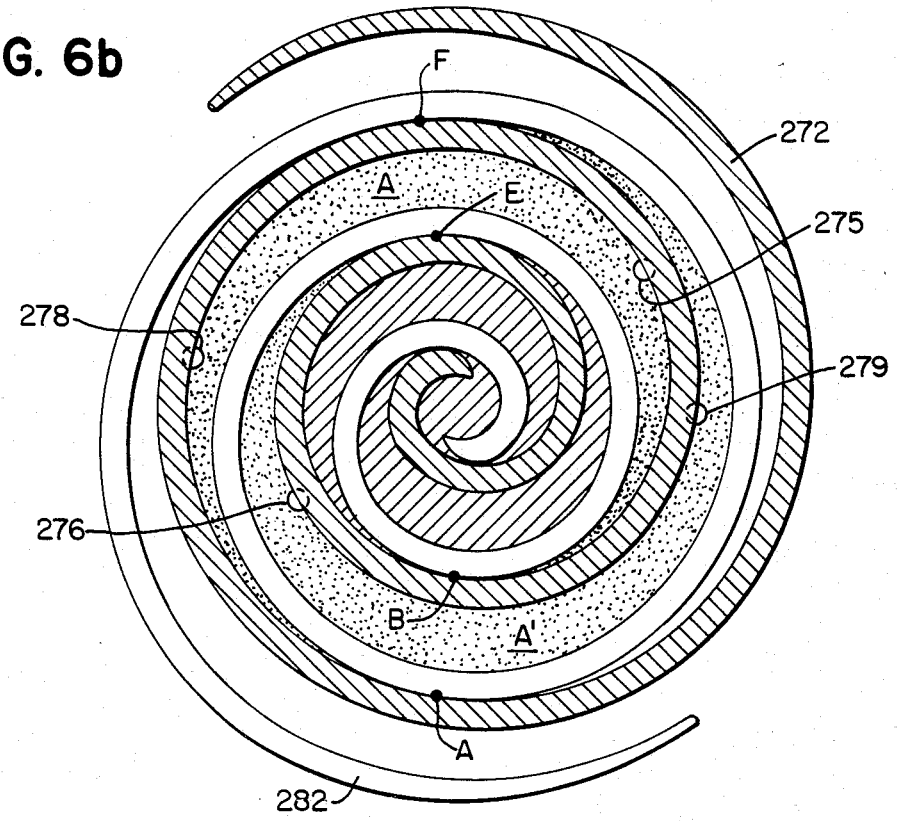
Figure 6C:
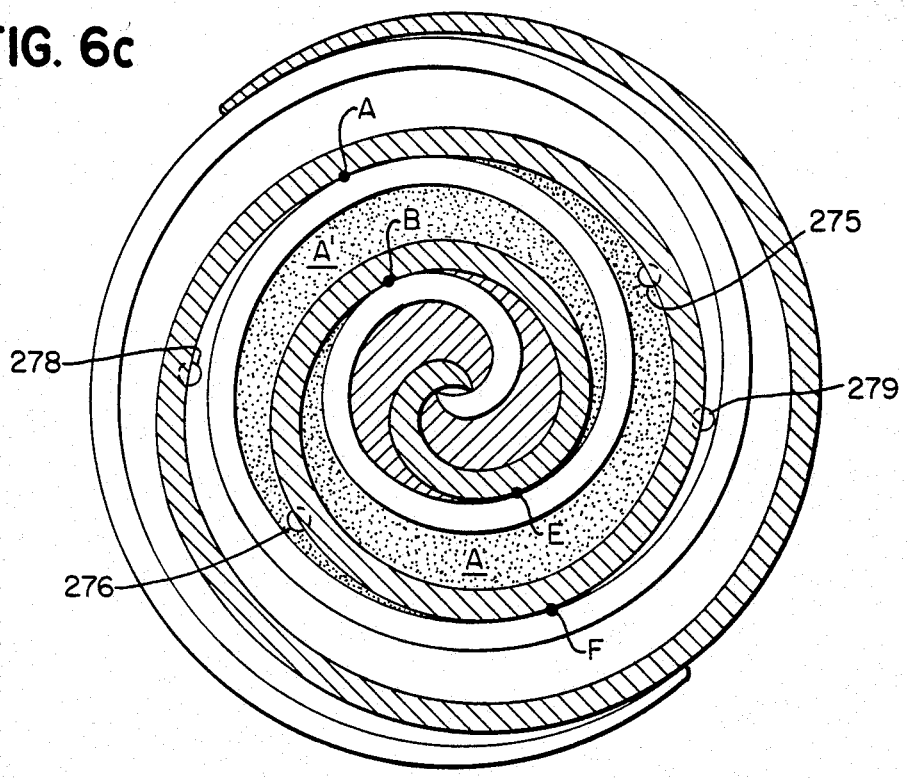
Figure 6D:
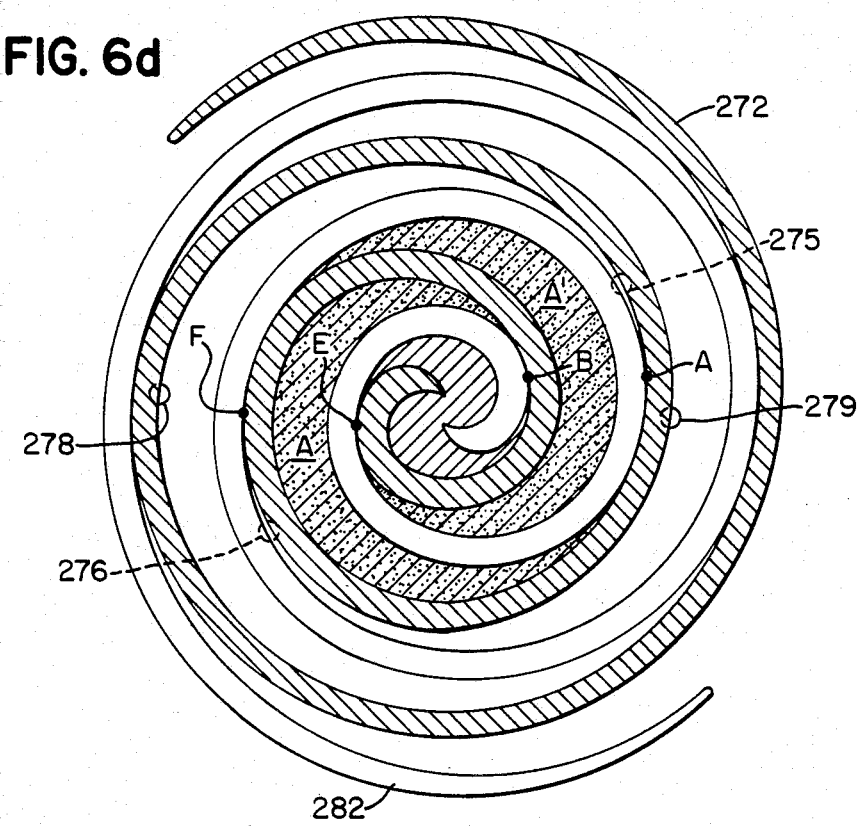

When valve member 371 is opened by magnetic coil 372, each hole 275, 276, 278 and 279 is opened. As shown in FIG. 6*b*, even though the sealed off fluid pockets have been formed by contact of the terminal ends of the spiral elements with the opposite spiral elements, fluid which has been taken into the sealed off fluid pockets A and A′ leaks from the sealed off fluid pockets A, A′ back to suction chamber 301 through the second pair of holes 278 and 279 as orbiting scroll 28 orbits. A small amount of fluid may also initially leak through the first pair of holes 275 and 276. During the orbital motion of orbiting scroll 28, the axial end surface of spiral element 282 of orbiting scroll 28 simultaneously crosses over the two holes 278 and 279. As shown in FIG. 6*c*, this blocks fluid communication between the fluid pockets A, A′ and suction chamber 301 through holes 277 and 278. However, before the second pair of holes 278 and 279 are simultaneously closed by the axial end surface of spiral element 282, the fluid pockets A, A′ are connected to suction chamber 301 through the first pair of holes 275 and 276, which are inwardly located relative to the pair of holes 278 and 279. Therefore, the leakage of fluid in the fluid pockets A, A′ continues until the axial end surface of spiral element 282 of orbiting scroll 28 crosses over and closes holes 275 and 276. This latter state, which is shown in FIG. 6*d*, prevents compression. As a result, the actual compression stroke of fluid pockets A, A′ starts after the spiral element 282 or orbiting scroll 28 crosses over holes 275 and 276. The volume of the fluid pockets A, A′ at the time these pockets are sealed from suction chamber 301, and compression actually begins, is thereby reduced. In this manner, the capacity of the compressor is reduced.

In this construction, the involute angle location of the first pair of holes 275 and 276 is placed within the area between $\phi$end-$2\pi$ and $\phi$end-$4\pi$. The second pair of holes 278 and 279 is placed with outward hole 278 within the area between $\phi$end and $\phi$end-$2\pi$. Accordingly, a large reduction of the displacement volume is realized without performing a useless compression operation. If the inward hole 276 is placed at $\phi$end-$4\pi$, the larger the reduction of displacement volume, i.e., the capacity difference between the normal operation and the displacement or volume adjustment operation will be larger. Conversely, if the outward hole 275 is placed at $\phi$end-$2\pi$, the consequent reduction of displacement volume is smaller.

This invention has been described in detail in connection with a preferred embodiment but this embodiment is merely for example only and this invention is not restricted thereto. It will be easily understood by those skilled in the art that other variations and modifications can be easily made within the scope of this invention, as defined by the appended claims.

We claim:

1. In a scroll type compressor including a pair of scrolls each having an end plate and a wrap extending from one side surface of said end plate, said wraps interfitting at an angular and radial offset to make a plurality of line contacts between said wraps to define at least one pair of sealed off fluid pockets, and a driving mechanism operatively connected to one of said scrolls for orbiting said one scroll relative to the other one of said scrolls while preventing rotation of said one scroll to thereby change the volume of the fluid pockets, the improvement comprising:

one end plate having at least two pairs of holes in fluid communication with a suction chamber, said holes of each pair of holes being located at symmetrical locations along the wrap which extends from said one end plate so that said other wrap simultaneously crosses over both of said holes in each pair of holes, the most inwardly placed hole of said pairs of holes being located within an area defined by $\phi\text{end-}2(n-1)\pi > \phi 1 > \phi\text{end-}2n\pi$, where $\phi$end is the final involute angle of said wrap which extends from said one end plate, $\phi 1$ is the involute angle at which said most inwardly placed hole is located and n is the number of pairs of holes, the most outwardly placed hole of said pairs of holes being located within an area defined by $\phi(n-1)+2\pi > \phi n > \phi\text{end-}2\pi$, and the intermediate holes of said pairs of holes being located within an area defined by $\phi(k-1)+2\pi > \phi k > \phi(k+1)-2\pi$, where $\phi k$ is the involute angle at which the kth hole from the most inwardly placed hole is located; and control means for selectively opening and closed said pairs of holes to permit fluid communication therethrough to said suction chamber to thereby selectively control the displacement volume of said compressor.

2. The scroll type compressor of claim 1 wherein said control means includes a valve member and an electromagnetic device, said valve member being attached to the end surface of said end plate and being spring biased to cover the opening of each of said holes, said electromagnetic device being supported adjacent said valve member to move said valve member away from said end surface to open said holes.

3. The scroll type compressor of claim 2 wherein said valve member comprises a separate flat plate attached adjacent each of said holes.

4. The scroll type compressor of claim 1 wherein said holes extend into a portion of said wrap which extends from said one end plate.

5. The scroll type compressor of claim 2 wherein said holes extend into a portion of said wrap which extends from said one end plate.

6. The scroll type compressor of claim 3 wherein said holes extend into a portion of said wrap which extends from said one end plate.

* * * * *